US009414151B2

(12) United States Patent
Kano et al.

(10) Patent No.: US 9,414,151 B2
(45) Date of Patent: Aug. 9, 2016

(54) SPEAKER SYSTEM

(71) Applicant: Panasonic Intellectual Property Management Co., Ltd., Osaka (JP)

(72) Inventors: Sawako Kano, Hyogo (JP); Toshiyuki Matsumura, Osaka (JP); Shuji Saiki, Nara (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 0 days.

(21) Appl. No.: 14/687,945

(22) Filed: Apr. 16, 2015

(65) Prior Publication Data

US 2015/0319523 A1 Nov. 5, 2015

(30) Foreign Application Priority Data

Apr. 30, 2014 (JP) ..... 2014-093948

(51) Int. Cl.

| | |
|---|---|
| ***H04R 1/28*** | (2006.01) |
| *H04R 3/04* | (2006.01) |
| *H04R 3/08* | (2006.01) |

(52) U.S. Cl.

CPC ..... *H04R 1/28* (2013.01); *H04R 1/2811* (2013.01); *H04R 1/2857* (2013.01); *H04R 3/04* (2013.01); *H04R 3/08* (2013.01); *H04R 2201/029* (2013.01)

(58) Field of Classification Search

CPC ..... H04R 1/28; H04R 1/2803; H04R 1/2807; H04R 1/2811; H04R 1/2815; H04R 1/2819; H04R 1/2853; H04R 1/2857; H04R 1/2869; H04R 1/2873; H04R 1/2876; H04R 1/288; H04R 1/2884; H04R 1/2888; H04R 3/04; H04R 3/08; H04R 2201/029

See application file for complete search history.

(56) References Cited

U.S. PATENT DOCUMENTS 1,836,222 A * 12/1931 Bonine ..... G10K 11/025 181/193
3,917,024 A * 11/1975 Kaiser, Jr. ..... G10K 13/00 181/155

(Continued)

FOREIGN PATENT DOCUMENTS

| | | |
|---|---|---|
| EP | 453230 | 10/1991 |
| GB | 2310104 | 8/1997 |
| WO | 01/11918 | 2/2001 |

OTHER PUBLICATIONS

The Extended European Search Report dated Oct. 9, 2015 for the related European Patent Application No. 15165402.7.

*Primary Examiner* — Curtis Kuntz
*Assistant Examiner* — Joshua Kaufman
(74) *Attorney, Agent, or Firm* — Greenblum & Bernstein, P.L.C.

(57) ABSTRACT

A speaker system includes a speaker cabinet that has an opening, a first speaker including a first diaphragm, and at least one acoustic tube opened at both ends. When an amplitude of vibration of the first diaphragm vibrated by applying a correction AC signal together with the first AC signal to the first speaker is equalized to the amplitude of vibration of the second diaphragm, a sound pressure reproduced by vibration of the first diaphragm is equal to or lower than a sound pressure reproduced by vibration of the second diaphragm of the second speaker. This is accomplished by applying a third AC signal having a frequency equal to or higher than a minimum resonance frequency of the closed type cabinet determined by the internal volume of the closed type cabinet and the caliber of the second speaker is applied to the second speaker.

16 Claims, 6 Drawing Sheets

(56) References Cited

U.S. PATENT DOCUMENTS 3,923,124 A * 12/1975 Hancock ..... H04R 1/2865 181/147
4,168,761 A * 9/1979 Pappanikolaou .... H04R 1/2857 181/152
4,628,528 A * 12/1986 Bose ..... H04R 3/04 181/145
4,924,962 A * 5/1990 Terai ..... H04R 1/2857 181/141
6,648,098 B2 * 11/2003 Nichols ..... H04R 1/2857 181/182
6,973,994 B2 * 12/2005 Mackin ..... H04R 1/00 181/145
7,284,638 B1 * 10/2007 Sahyoun ..... H04R 1/2857 181/156
9,161,119 B2 * 10/2015 Powell ..... H04R 1/2853
2008/0101640 A1 * 5/2008 Ballad ..... G10K 11/025 381/338
2012/0300967 A1 * 11/2012 Saiki ..... H04R 1/288 381/349
2015/0129351 A1 * 5/2015 Wheeler ..... H04R 1/2853 181/152
2015/0319523 A1 * 11/2015 Kano ..... H04R 1/2857 381/338

* cited by examiner

SPEAKER SYSTEM

BACKGROUND

1. Technical Field

The present disclosure relates to a speaker system using an open acoustic tube.

2. Description of the Related Art

In a speaker system for a vehicle, reproduction is demanded to be performed with sound volumes sufficient in a low frequency range to create powerful sounds. For this purpose, in a structure in which a speaker unit is attached to a closed type cabinet, reproduction has been performed with a sound pressure level in a low frequency range electrically corrected and thereby increased. For example, FIG. 9 is a conceptual diagram of a sound pressure frequency characteristic before and after the correction. FIG. 9 is a diagram illustrating sound pressure characteristics with respect to frequencies in a structure in which a speaker unit is attached to a closed type cabinet. In FIG. 9, the solid line represents a sound pressure characteristic with respect to frequencies when electrical correction is performed on a sound pressure level in a low frequency range and the dotted line represents a sound pressure characteristic with respect to frequencies when electrical correction is not performed on a sound pressure level in a low frequency range. When electrical correction is performed on a sound pressure level in a low frequency range, electrical amplification is performed on a band equal to or lower than the resonance frequency of the closed type cabinet determined by the caliber of the speaker unit and the internal volume of the closed type cabinet, whereby a sound pressure substantially equal to that in a medium and high frequency range is reproduced.

SUMMARY

In one general aspect, the techniques disclosed here feature a speaker system including a speaker cabinet that has an opening, a first speaker unit attached to the speaker cabinet, and at least one acoustic tube opened at both ends thereof. One end of the acoustic tube is positioned inside the speaker cabinet. The other end of the acoustic tube is connected to the opening. In a case where an amplitude of vibration of a first diaphragm of the first speaker unit vibrated by applying a first AC signal having a frequency included in a first frequency band and a correction AC signal having the same frequency as the first AC signal to the first speaker unit is equalized to an amplitude of vibration of a second diaphragm of a second speaker unit vibrated by applying a second AC signal being the same as the first AC signal to the second speaker unit in a manner that the second speaker unit being the same as the first speaker unit is attached to a closed type cabinet having the same internal volume as the speaker cabinet, a sound pressure reproduced by vibration of the first diaphragm is equal to or lower than a sound pressure reproduced by vibration of the second diaphragm when a third AC signal having a frequency equal to or higher than a minimum resonance frequency of the closed type cabinet determined by the internal volume of the closed type cabinet and the caliber of the second speaker unit is applied to the second speaker unit. The first frequency band includes a first resonance frequency determined by an acoustic mass of the acoustic tube and an acoustic compliance component which is determined by an internal volume of the speaker cabinet excluding a volume of the acoustic tube. The first frequency is lower than the minimum resonance frequency of the closed type cabinet.

One non-limiting and exemplary embodiment of the speaker system according to the present disclosure provides a speaker system enabling reproduction with a high sound pressure and a low distortion in a low frequency band corresponding to the first frequency band.

Additional benefits and advantages of the disclosed embodiments will become apparent from the specification and drawings. The benefits and/or advantages may be individually obtained by the various embodiments and features of the specification and drawings, which need not all be provided in order to obtain one or more of such benefits and/or advantages.

DETAILED DESCRIPTION

Firstly, matters studied by the inventors for disclosing each aspect of the present disclosure will be described.

(Underlying Knowledge Forming Basis of the Present Disclosure)

Figure 9:
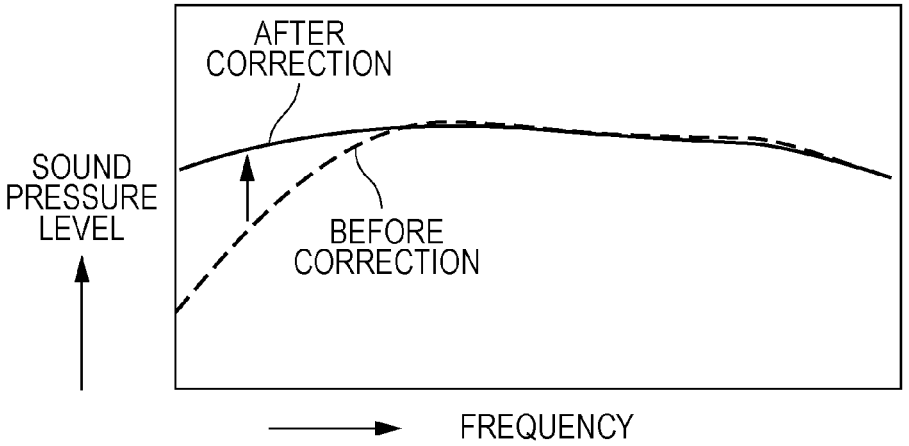
FIG. 9 PRIOR ART
FIG. 9 is a conceptual diagram of a sound pressure frequency characteristic before and after electrical correction when a speaker unit is attached to a closed type cabinet.

As illustrated in FIG. 9, when a sound pressure in a low frequency range is electrically amplified, the amplitude of vibration of a diaphragm in a speaker unit is increased in proportion to the sound pressure. Accordingly, the vibration mode and the driving force of the diaphragm are deviated from a linear region and a distortion included in a reproduced sound is increased. As a result, sufficient amplification is inhibited and a target characteristic cannot be achieved. Furthermore, a low frequency component of a sound source in which a significant distortion is generated will need to be suppressed with a high-pass filter. These have been problems hindering sufficient low-frequency range reproduction. The present disclosure solves the above-described problems with conventional techniques and provides a speaker system in which high sound pressure reproduction and low distortion reproduction are both achieved in a low frequency range.

A speaker system according to the present disclosure includes a speaker cabinet that has an opening, a first speaker unit attached to the speaker cabinet, and at least one acoustic tube opened at both ends thereof. One end of the acoustic tube is positioned inside the speaker cabinet. The other end of the acoustic tube is connected to the opening. In a case where an amplitude of vibration of a first diaphragm of the first speaker unit vibrated by applying a first AC signal having a frequency included in a first frequency band and a correction AC signal having the same frequency as the first AC signal to the first speaker unit is equalized to an amplitude of vibration of a second diaphragm of a second speaker unit vibrated by applying a second AC signal being the same as the first AC signal to the second speaker unit in a manner that the second speaker unit being the same as the first speaker unit is attached to a closed type cabinet having the same volume as the speaker cabinet, a sound pressure reproduced by vibration of the first diaphragm is equal to or lower than a sound pressure reproduced by vibration of the second diaphragm when a third AC signal having a frequency equal to or higher than a minimum resonance frequency of the closed type cabinet determined by the volume of the closed type cabinet and the caliber of the second speaker unit is applied to the second speaker unit. The first frequency band includes a first resonance frequency determined by an acoustic mass of the acoustic tube and an acoustic compliance component which is determined by an internal volume of the speaker cabinet excluding a volume of the acoustic tube. The first frequency is lower than the minimum resonance frequency of the closed type cabinet.

When the first resonance frequency is defined as a frequency in a low frequency range, the amplitude when the first diaphragm of the first speaker unit is vibrated by applying the first AC signal having a frequency included in the first frequency band to the first speaker unit can be made smaller than a second amplitude when the second diaphragm of the second speaker unit is vibrated by applying the second AC signal being the same as the first AC signal to the second speaker unit in a manner that the second speaker unit being the same as the first speaker unit is attached to the closed type cabinet.

This creates, in the first frequency band, a room for increasing the amplitude when the first diaphragm is vibrated.

In a structure in which the second speaker unit being the same as the first speaker unit is attached to the closed type cabinet, to increase a sound pressure in the vicinity of a frequency in a low frequency range, a correction AC signal that causes the second diaphragm of the second speaker unit to vibrate with an amplitude larger than the second amplitude has to be applied to the second speaker unit. This increases a distortion included in the sound pressure in the vicinity of a frequency in a low frequency range in the closed type cabinet.

According to the present disclosure, when a correction AC signal that increases the amplitude of the first speaker unit to the level of the second amplitude in the first frequency band is applied to the first speaker unit, the distortion included in the sound pressure at a frequency in a low frequency range is smaller than that caused when a correction AC signal is applied to the second speaker unit, and furthermore, the sound pressure level can be made higher.

With this configuration, the speaker system according to the present disclosure can provide a speaker system enabling reproduction with a high sound pressure and a low distortion in a low frequency band corresponding to the first frequency band.

In the speaker system according to the present disclosure, the acoustic tube may be spiral-shaped.

With this structure, because a long acoustic tube can be provided inside the speaker cabinet, the first resonance frequency can be set to a frequency in a low frequency range.

In the speaker system according to the present disclosure, the acoustic tube may be structured by connecting a spiral-shaped plate member disposed inside the speaker cabinet and two inner wall faces facing each other out of the inner wall faces of the speaker cabinet.

With this structure, because a long acoustic tube can be provided inside the speaker cabinet, not only the first resonance frequency can be set to a frequency in a low frequency range but also the spiral-shaped plate member disposed inside the speaker cabinet also serves as a reinforcing plate of the speaker cabinet, whereby box resonance is prevented and rigidity is increased in the speaker cabinet.

In the speaker system according to the present disclosure, the spiral-shaped plate member may also serve as a reinforcing member of the speaker cabinet.

With this structure, no reinforcing member other than the spiral-shaped plate member needs to be provided in the speaker cabinet.

In the speaker system according to the present disclosure, the shape of the acoustic tube may be a meandering shape inside the speaker cabinet.

With this structure, because a long acoustic tube can be provided inside the speaker cabinet, the first resonance frequency can be set to a frequency in a low frequency range.

The speaker system according to the present disclosure may include a plurality of first plate members each having one end face connected to part of a first inner wall face of the speaker cabinet and a second plate member with one end face connected to part of a second inner wall face of the speaker cabinet, the second inner wall face facing the first inner wall face. The plurality of first plate members may be disposed spatially apart from each other and the other end face of each of the plurality of first plate members opposite the one end face of each of the plurality of first plate member may be positioned away from a second inner wall face. The second plate member may be disposed in a position between the first plate members adjacent to each other and away from each of the first plate members adjacent to each other. The other end face of the second plate member opposite one end face of the second plate member may be positioned away from the first inner wall face. The acoustic tube may be formed of the plurality of first plate members and the second plate member respectively connected to a third inner wall face and a fourth inner wall face that are two inner wall faces facing each other out of the inner wall faces of the speaker cabinet and respectively different from the first inner wall face and the second inner wall face.

With this structure, because a long acoustic tube can be provided inside the speaker cabinet, not only the first resonance frequency can be set to a frequency in a low frequency range but also the spiral-shaped plate member disposed inside the speaker cabinet also serves as a reinforcing plate of the speaker cabinet, whereby box resonance is prevented and rigidity is increased in the speaker cabinet.

In the speaker system according to the present disclosure, the first plate member and the second plate member may also serve as reinforcing members of the speaker cabinet.

With this structure, no reinforcing member other than the first plate member and the second plate member needs to be provided in the speaker cabinet.

In the speaker system according to the present disclosure, the cross section area perpendicular to the length direction of the acoustic tube may be made smaller in part.

When an acoustic tube in which the cross section area perpendicular to the length direction of the acoustic tube is not made smaller in part, that is, the cross section area perpendicular to the length direction is the same in every part (referred to as a first acoustic tube) is compared with an acoustic tube in which the cross section area perpendicular to the length direction of the acoustic tube is made smaller in part (referred to as a second acoustic tube), if the length of the first acoustic tube and that of the second acoustic tube are the same, the acoustic mass of the second acoustic tube is larger than that of the first acoustic tube.

If the length of the first acoustic tube and that of the second acoustic tube are the same, as an acoustic tube to be attached to the speaker cabinet, the second acoustic tube can be attached to obtain a larger acoustic mass compared with the first acoustic tube, whereby the resonance frequency (the first resonance frequency) determined by the acoustic mass of the acoustic tube and the acoustic compliance determined by the back volume of the speaker unit can be set to a lower value.

Furthermore, when the resonance frequency set when the first acoustic tube is used as an acoustic tube to be attached to a speaker cabinet 1 is the same as the resonance frequency set when the second acoustic tube is used as an acoustic tube to be attached to the speaker cabinet, the length of the second acoustic tube is shorter than that of the first acoustic tube. Thus, the second acoustic tube, of which the length is shorter than that of the first acoustic tube, can be used to obtain the resonance frequency when the first acoustic tube is used.

In the speaker system according to the present disclosure, the first frequency band is a frequency band of 16 Hz to 45 Hz and a sound pressure reproduced by vibration of the first diaphragm when a first AC signal having a frequency in the vicinity of the first resonance frequency is applied to the first speaker unit is substantially the same as a sound pressure reproduced by vibration of the second diaphragm when a second AC signal being the same as the first AC signal is applied to the second speaker unit.

In the speaker system according to the present disclosure, being substantially the same indicates that the absolute value of the difference between the sound pressure reproduced by vibration of the first diaphragm and the sound pressure reproduced by vibration of the second diaphragm is within 1 dB.

In the speaker system according to the present disclosure, the percentage of the internal volume of the acoustic tube to that of the speaker cabinet is equal to or higher than 5%.

In the speaker system according to the present disclosure, a second resonance frequency determined by a length of the acoustic tube substantially coincides with the peak frequency of the sound pressure of the speaker unit attached to the speaker cabinet.

With this structure, the sharpness (Q) in the peak frequency of the speaker unit can be suppressed, whereby the peak frequency characteristic of the speaker unit can be flattened.

In the speaker system according to the present disclosure, a sound absorption material may be disposed as part of the acoustic tube.

With this structure, rapid changes (dips) of the amplitude characteristic of the diaphragm of the speaker unit in the vicinity of the second resonance frequency determined by the length of the acoustic tube can be reduced.

In the speaker system according to the present disclosure, the acoustic tube may form surrounding walls of the speaker cabinet.

In the speaker system according to the present disclosure, when the same AC signal having a frequency of the second frequency that is lower than the minimum resonance frequency and different from the first frequency band is applied to each of the first speaker unit and the second speaker unit, the sound pressure reproduced by vibration of the first diaphragm is substantially the same as the sound pressure reproduced by vibration of the second diaphragm.

In the speaker system according to the present disclosure, being substantially the same indicates that the absolute value of the difference between the sound pressure reproduced by vibration of the first diaphragm and the sound pressure reproduced by vibration of the second diaphragm is within 1 dB.

Embodiments according to the present disclosure will be described below with reference to the drawings.

(Embodiment 1)

Figure 1A:
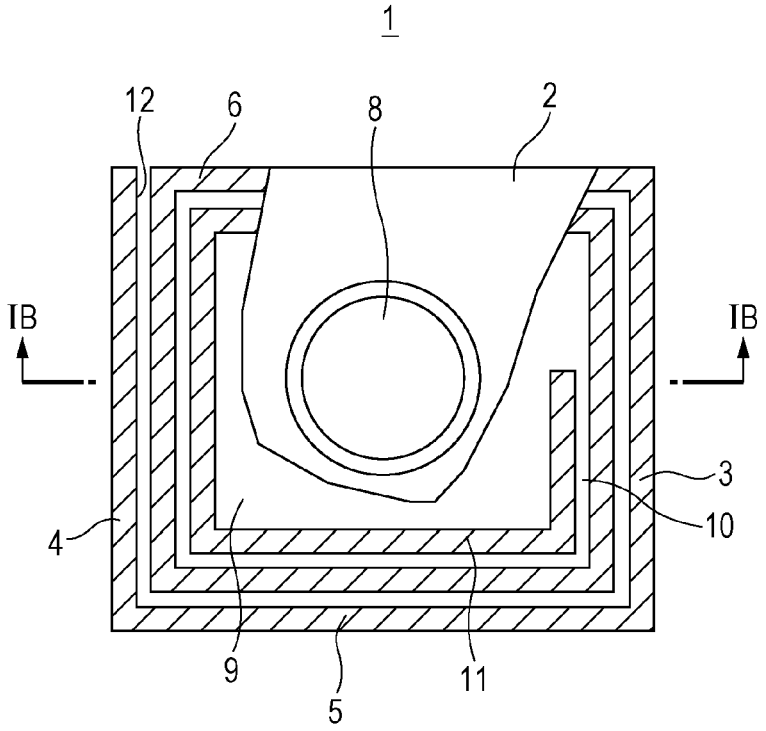
FIG. 1A is a plan view of a speaker system according to Embodiment 1 of the present disclosure.
Figure 1B:
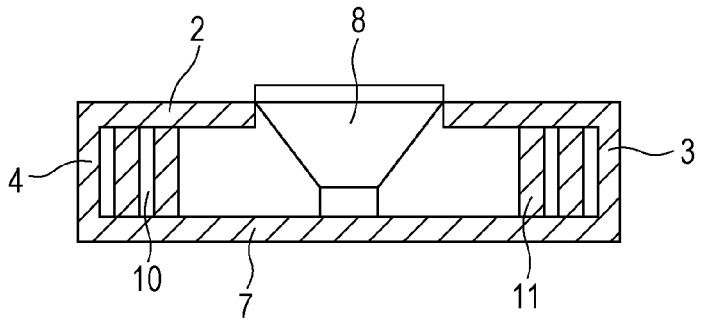
FIG. 1B is a cross-section view of the speaker system according to Embodiment 1 of the present disclosure.

FIG. 1A is a plan view of a speaker system part of which is cut off according to Embodiment 1 of the present disclosure. FIG. 1B is a cross-section view taken along line IB-IB in FIG. 1A.

The speaker system includes a speaker cabinet 1, a speaker unit 8 attached to a front face plate 2 of the speaker cabinet 1, a partition plate 11 provided inside the speaker cabinet 1, and an opening 12 provided on a side face plate 6 of the speaker cabinet 1.

The speaker cabinet 1 includes the front face plate 2 to which the speaker unit 8 (the first speaker unit) is attached, the side face plate 6 on which the opening 12 is provided, a side face plate 3, a side face plate 4, and a side face plate 5, which are for three faces other than the side face plate 6, a rear face plate 7, and the partition plate 11 provided inside the speaker cabinet 1.

The faces of the front face plate 2, the side face plate 3, the side face plate 4, the side face plate 5, the side face plate 6, and the rear face plate 7 that are positioned outside the speaker cabinet 1 form the outer frame of the speaker cabinet 1. The outer frame of the speaker cabinet 1 has a hexahedral shape.

Furthermore, each of the faces of the front face plate 2, the side face plate 3, the side face plate 4, the side face plate 5, the side face plate 6, and the rear face plate 7 that are positioned inside the speaker cabinet 1 form the inner walls (or inner wall faces) of the speaker cabinet 1.

The partition plate 11 is spiral-shaped along the side face plate 3, the side face plate 4, the side face plate 5, and the side face plate 6.

The partition plate 11 is connected to (or joined with) two inner wall faces facing each other out of the inner wall faces of the speaker cabinet 1. For example, the partition plate 11 is connected to the front face plate 2 and the rear face plate 7 inside the speaker cabinet 1.

An end of the partition plate 11 is connected to the vicinity of an end of the side face plate 6 inside the speaker cabinet 1.

The partition plate 11 may be formed of a plurality of plate members of which the ends are connected to one another to form a spiral shape, or may be formed of a spiral-shaped plate member.

Furthermore, if the spiral-shaped partition plate 11 is formed integrally with the side face plate 3, the side face plate 4, the side face plate 5, and the side face plate 6, the outermost periphery of the spiral-shaped partition plate 11 forms the side face plate 3, the side face plate 4, the side face plate 5, and the side face plate 6.

Inside the speaker cabinet 1, a spiral-formed acoustic tube 10 is formed of spiral-shaped inner and outer partition plates 11, the front face plate 2, and a rear face plate 7, or formed of the partition plates 11, the side face plate 3, the side face plate 4, the side face plate 5, the side face plate 6, the front face plate 2, and the rear face plate 7.

Both ends of the acoustic tube 10 structured as described above are opened. One opening (or one end) of the acoustic tube 10 is positioned in the back volume part 9 of the speaker unit 8.

Furthermore, the other opening (or the other end) of the acoustic tube 10 is connected to the opening 12 provided on the side face plate 6.

The back volume part 9 of the speaker unit 8 and the outside of the speaker cabinet 1 (or the outside of the speaker system) are connected through the acoustic tube 10 and the opening 12. The back volume part 9 is a space, inside the speaker cabinet 1, which is located at the back of the speaker unit 8. In the speaker cabinet 1, the back volume part 9 does not include a space of the acoustic tube 10. Namely, the back volume part 9 is a space inside the speaker cabinet 1 excluding a space in which the acoustic tube 10 is arranged.

The speaker system according to Embodiment 1 includes two resonance frequencies, for example. One is a resonance frequency determined by the acoustic mass of the acoustic tube 10 and the acoustic compliance, in the speaker cabinet 1, determined by the back volume of the speaker unit 8. The back volume of the speaker unit 8 is a volume of a space corresponding to the back volume part 9. Namely, the back volume of the speaker unit 8 is an internal volume of the speaker cabinet 1 excluding a volume of the acoustic tube 10. The other is a resonance frequency determined by the length of the acoustic tube 10.

In the description below, the resonance frequency determined by the acoustic mass of the acoustic tube 10 and the acoustic compliance determined by the back volume of the speaker unit 8 in the speaker system according to Embodiment 1 will be referred to as a first resonance frequency.

The resonance frequency determined by the length of the acoustic tube 10 in the speaker system according to Embodiment 1 will be referred to as a second resonance frequency in the description.

The operation performed by the speaker system structured as described above will now be described.

When an AC signal (for example, an AC voltage or an AC current) is applied to the speaker unit 8, a diaphragm (the first diaphragm, not illustrated) included in the speaker unit 8 is vibrated, and a sound is reproduced.

The reproduced sound is radiated to the outside of the speaker cabinet 1. At this time, the reproduced sound is also radiated to the back volume part 9 which is a space inside the speaker cabinet 1 at the rear face of the diaphragm.

The sound radiated to the space inside the speaker cabinet 1 is propagated to the inside of the acoustic tube 10.

Out of the sounds propagated to the inside of the acoustic tube 10, only the sound radiated by vibration of the diaphragm in accordance with an AC signal having a frequency in the vicinity of the first resonance frequency is radiated to the outside of the speaker cabinet 1 through the acoustic tube 10 and the opening 12.

To describe the effect of the speaker system according to Embodiment 1, the speaker system according to Embodiment 1 is compared with a speaker system (referred to as a speaker system to be compared) in which the same speaker unit as the speaker unit 8 (the second speaker unit) is attached to a closed type cabinet having an internal volume obtained by adding the back volume of the speaker unit 8 to the internal volume of the acoustic tube 10. The internal volume of the closed type cabinet is equivalent to the internal volume of the speaker cabinet 1.

This closed type cabinet does not include therein the acoustic tube 10 (especially, the partition plate 11) as illustrated in FIGS. 1A and 1B.

The speaker system to be compared has a resonance frequency determined by the caliber of the speaker unit attached to the closed type cabinet and the internal volume of the closed type cabinet.

In the description below, in the speaker system to be compared, the resonance frequency determined by the caliber of the speaker unit attached to the closed type cabinet and the internal volume of the closed type cabinet is referred to as a minimum resonance frequency of the closed type cabinet.

In the speaker system according to Embodiment 1, the acoustic mass of the acoustic tube 10 and the back volume of the speaker unit 8 are designed such that the first resonance frequency is lower than the minimum resonance frequency of the closed type cabinet. The acoustic mass of the acoustic tube 10 depends on the length and the cross section area of the acoustic tube 10, for example.

Therefore, if any one of the length or the cross section area of the acoustic tube 10 is changed, the acoustic mass of the acoustic tube 10 changes in accordance therewith.

The speaker cabinet 1 illustrated in FIGS. 1A and 1B has an internal dimension of 307 mm length×366 mm width×65 mm height. The internal volume of the speaker cabinet 1 is at a value obtained by adding the volume of the back volume part 9 to the internal volume of the acoustic tube 10. In this example, the total internal volume of the speaker cabinet 1 is 5 L.

The speaker unit 8 is an electrodynamic type speaker having a diameter of 16 cm. The cross section of the acoustic tube 10 has an area of 65 mm length×11 mm width and has a length of 2 m. The percentage of the internal volume of the acoustic tube 10 is 28% to the total internal volume.

With this structure, the first resonance frequency in the speaker system according to Embodiment 1 is 16 Hz.

On the other hand, the minimum resonance frequency in the closed type cabinet created with consideration for the above-described value is 70 Hz.

Figure 2:
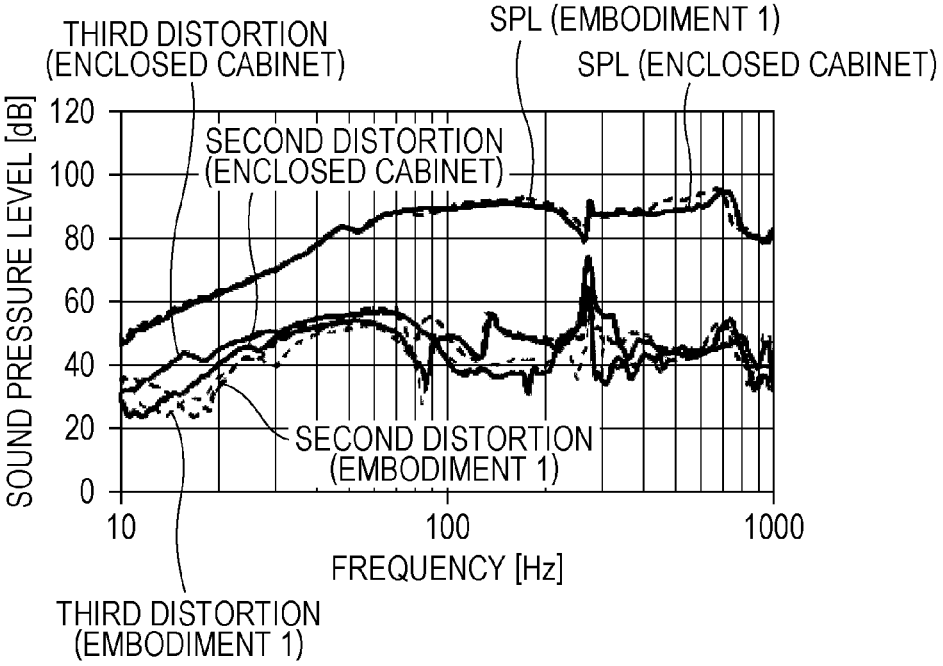
FIG. 2 is a diagram illustrating a sound pressure frequency characteristic according to Embodiment 1 of the present disclosure.

FIG. 2 is a diagram of a case where AC signals having the same amplitude are applied to the speaker unit of the speaker system according to Embodiment 1 and the speaker unit of the speaker system to be compared, and illustrates the relation between the frequencies of the AC signals and the sound pressure levels (SPL) of the sounds reproduced from the diaphragm of each speaker unit (sound pressure frequency characteristic).

In FIG. 2, the horizontal axis is the frequencies of AC signals applied and the vertical axis is the sound pressure levels of the speaker system. The speaker unit 8 of the speaker system according to Embodiment 1 (the first speaker unit) and the speaker unit of the speaker system to be compared (the second speaker unit) are the same speaker units.

Figure 3:
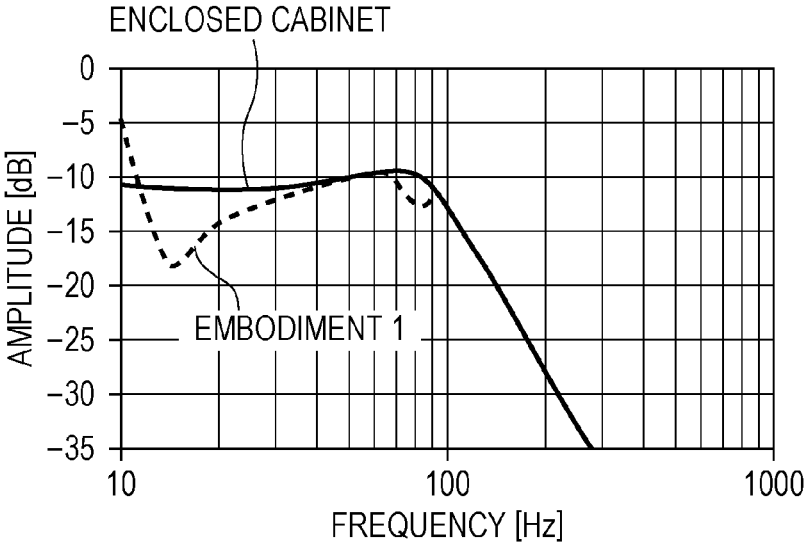
FIG. 3 is a diagram illustrating an amplitude frequency characteristic according to Embodiment 1 of the present disclosure.

FIG. 3 is a diagram of a case where AC signals having the same amplitude are applied to the speaker unit 8 of the speaker system according to Embodiment 1 and the second speaker unit of the speaker system to be compared, and illustrates the relation between the frequencies of the AC signals and the amplitude of vibration of the diaphragm of each speaker unit (amplitude frequency characteristic).

In FIG. 3, the horizontal axis is the frequencies of AC signals applied and the vertical axis is the amplitudes (specifically, the calculated logarithm values of the amplitudes) of the diaphragms of the speaker units.

From the amplitude characteristic (the solid line) of the diaphragm of the second speaker unit of the speaker system to be compared, it can be understood that the amplitude of vibration of the second diaphragm at the minimum resonance frequency or lower (in this example, 70 Hz or lower) of the closed type cabinet is substantially constant.

Accordingly, to amplify the sound pressure of the closed type cabinet at the minimum resonance frequency or lower in the speaker system to be compared, the amplitude of vibration of the second diaphragm of the second speaker unit needs to be increased.

By contrast, the speaker system according to Embodiment 1 (speaker system in which the speaker unit 8 is attached to the speaker cabinet 1) is designed such that the first resonance frequency is a frequency lower than the minimum resonance frequency of the closed type cabinet (in this example, 16 Hz).

It can be understood from FIG. 3 that in the speaker system according to Embodiment 1, when an AC signal having a frequency included in the first frequency band including the first resonance frequency (in this example, in the range from 16 Hz to 45 Hz, more preferably, from 16 Hz to 30 Hz) is applied, the amplitude of vibration of the diaphragm of the speaker unit 8 is smaller than that of the second diaphragm of the second speaker unit of the speaker system to be compared.

Next, as illustrated in FIG. 2, the sound pressure frequency characteristic of the speaker system according to Embodiment 1 (the dotted line) and the sound pressure frequency characteristic of the speaker system to be compared (the solid line) are similar.

Especially, in the first frequency band described above, the absolute value of the difference between the sound pressures of the two speaker systems is kept within 1 dB. This indicates that the characteristics of the two speaker systems are substantially the same.

Furthermore, in the second frequency band lower than the minimum resonance frequency and different from the above-described first frequency band (for example, in the range from 45 Hz to 65 Hz), the absolute value of the difference between the characteristics of the two speaker systems is within 1 dB. This indicates that the characteristics of the two speaker systems are substantially the same.

The sound pressure characteristics represented in FIG. 2 indicates that in a case where the same speaker unit is attached to the speaker cabinet 1 according to Embodiment 1 and the closed type cabinet, when AC signals having the same frequency and the same amplitude are applied to the speaker units, no significant difference is caused between the two cabinets in view of the sound pressure characteristics with respect to the frequencies.

Furthermore, FIG. 2 represents the sound pressure characteristics with respect to the second distortions and the third distortions included in the sounds reproduced in the speaker system according to Embodiment 1 and the speaker system to be compared.

From the sound pressure frequency characteristics with respect to the second distortions and the third distortions in the speaker system according to Embodiment 1 and the speaker system to be compared, it can be understood that in the first frequency band, the sound pressure levels of the second distortions and the third distortions in the speaker system according to Embodiment 1 are lower than the sound pressure levels of the second distortions and the third distortions in the speaker system to be compared.

This indicates that the speaker system according to Embodiment 1 is superior to the speaker system to be compared in view of reducing distortions in the reproduced sounds (or in view of low distortion reproduction).

On the other hand, as indicated in FIG. 3 by the amplitude characteristic of the diaphragm (the first diaphragm) of the speaker unit 8 (the first speaker unit) in the speaker system according to Embodiment 1 and the amplitude characteristic of the diaphragm (the second diaphragm) of the second speaker unit of the speaker system to be compared, at the minimum resonance frequency of the closed type cabinet (70 Hz) or lower in the second frequency band (in the range from 45 Hz to 65 Hz), the amplitudes of the two speaker units are substantially the same.

By contrast, in the first frequency band, it can be understood that the amplitude characteristics of the two speaker units are greatly different.

It can be understood that in the speaker system to be compared in FIG. 3, the amplitude of vibration of the second diaphragm is substantially constant in the first frequency band.

As described above, the closed type cabinet does not include the acoustic tube 10. In the speaker system to be compared, resonance is thus not generated at the first resonance frequency. Accordingly, it can be understood that even when an AC signal having a frequency in the vicinity of the first frequency is applied to the second speaker unit, no significant change is generated.

By contrast, the speaker system according to Embodiment 1 is designed such that resonance is generated at the first resonance frequency. Accordingly, it can be understood that when an AC signal having a frequency included in the first frequency band (especially, a frequency in the vicinity of the first resonance frequency) is applied to the first speaker unit, the amplitude of that of the first speaker unit is smaller than that of the second speaker unit when the same AC signal is applied to the second speaker unit.

From the matters described above, it can be understood that in the first frequency band, the amplitude of vibration of the diaphragm of the speaker unit 8 (the first speaker unit) of the speaker system according to Embodiment 1 is smaller than the amplitude vibration of the diaphragm of the second speaker unit of the speaker system to be compared.

The inventors has noted that when the structure of the speaker system according to Embodiment 1 is employed, in the first frequency band, there is a room for increasing the amplitude of vibration of the diaphragm (the first diaphragm) of the speaker unit 8 (the first speaker unit) to a degree equal to the amplitude of vibration of the diaphragm (the second diaphragm) of the second speaker unit of the speaker system to be compared.

As described above with reference to FIG. 3, in the first frequency band, the value of the amplitude of vibration of the diaphragm of the speaker unit 8 when an AC signal including a frequency included in the first frequency band (the first AC signal) is applied to the speaker unit 8 of the speaker system according to Embodiment 1 is different from the value of the amplitude of vibration of the diaphragm of the second speaker unit when an AC signal being the same as the first AC signal (the second AC signal) is applied to the second speaker unit of the speaker system to be compared.

For example, when an AC signal including the first resonance frequency and equalizing to the value of the amplitude of vibration of the diaphragm of the second speaker unit (correction AC signal) is applied to the speaker unit 8 together with the first AC signal, the value of the amplitude of vibration of the diaphragm of the speaker unit 8 can be increased at the first resonance frequency.

This is true not only with an AC signal including the first resonance frequency but also with an AC signal including a frequency in the first frequency band (in this example, in the range from 16 Hz to 45 Hz, preferably, 16 Hz to 30 Hz).

At this time, a distortion generated when the value of the amplitude of vibration of the diaphragm of the speaker unit 8 is increased can be made smaller than a distortion generated when the value of the amplitude of vibration of the diaphragm of the second speaker unit is increased.

Furthermore, when the value of the amplitude of vibration of the diaphragm of the speaker unit 8 in the first frequency band is increased, the sound pressure level of the speaker unit 8 in the first frequency band is increased.

Accordingly, the sound pressure characteristic of the speaker system according to Embodiment 1 in the first frequency band corresponding to a low frequency band is improved.

Figure 4:
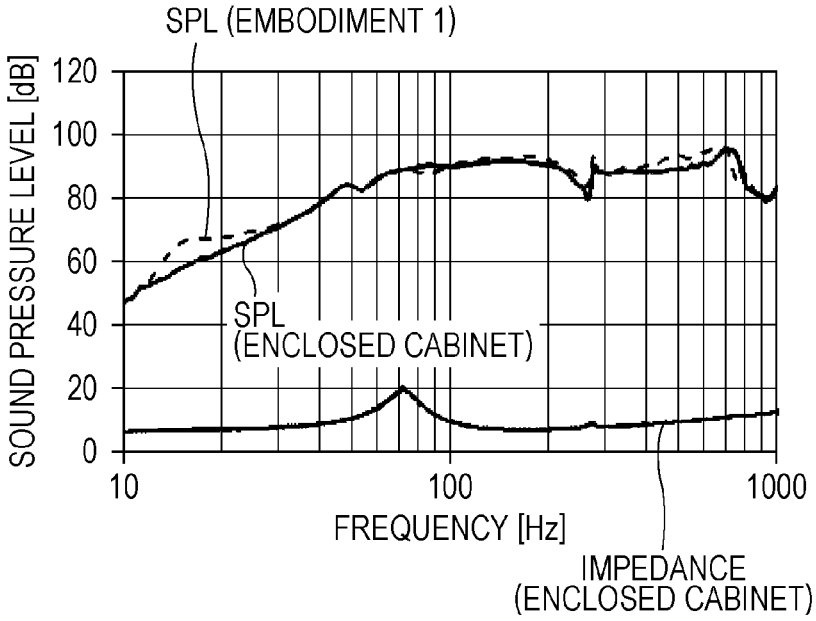
FIG. 4 is a diagram illustrating a sound pressure frequency characteristic with a same amplitude according to Embodiment 1 of the present disclosure.

FIG. 4 is a diagram illustrating the sound pressure frequency characteristic (the dotted line) of the speaker system according to Embodiment 1 when the correction AC signal is applied to the speaker unit 8 together with the first AC signal in the first frequency band.

FIG. 4 further illustrates the acoustic impedance characteristic with respect to the frequency of the speaker system to be compared and the sound pressure characteristic with respect to the frequency of the speaker system to be compared which is illustrated in FIG. 2.

Furthermore, as illustrated in FIG. 4, the acoustic impedance characteristic with respect to the frequency of the closed type cabinet indicates that the minimum resonance frequency of the closed type cabinet is in the vicinity of 70 Hz.

As illustrated in FIG. 4, in the first frequency band, a correction AC signal having a frequency being the same as the first AC signal is applied to the speaker unit 8 together with the first AC signal having a frequency included in the first frequency band, and it can be thus understood that the sound pressure characteristic of the speaker system according to Embodiment 1 is improved in the first frequency band.

Furthermore, the sound pressure level in the vicinity of the first resonance frequency (in this example, 70 dB) is lower than the sound pressure level when an AC signal (the third AC signal) having the same amplitude as the first AC signal is applied to the speaker unit 8 (or the second speaker unit) (in this example, 90 dB). The third AC signal has a frequency of the minimum resonance frequency of the closed type cabinet or higher (in this example, 70 Hz or higher). This is because, as the reproduction sound pressure in the first band, a sound pressure of the reproduction sound pressure or higher in the band of the minimum resonance frequency or higher is not required.

Accordingly, in the speaker system according to Embodiment 1, the sound pressure characteristic in a low frequency band (in this example, 16 Hz to 45 Hz) can be improved by applying a correction AC signal in the first frequency band.

As described above, the speaker system according to Embodiment 1 has a significant characteristic in the structure thereof designed such that the resonance frequency (the first resonance frequency) is included in a low frequency band by adjusting the acoustic mass of the acoustic tube 10 and the acoustic compliance determined by the back volume of the speaker unit 8.

With this structure, in a low frequency band, a room for increasing the amplitude of vibration of the diaphragm of the speaker unit 8 can be secured with no problem. With this, the sound pressure characteristic in a low frequency band corresponding to the first frequency band can be improved by applying a correction AC signal to the speaker unit 8.

Accordingly, compared with a speaker system in which a speaker unit being the same as the speaker unit 8 is attached to an closed type cabinet having an internal volume obtained by adding the back volume of the speaker unit 8 to the volume of the acoustic tube 10, the speaker system according to the present embodiment enables high sound pressure reproduction and low distortion reproduction in a low frequency band.

Furthermore, in the speaker system to be compared, a closed type cabinet is used. When a closed type cabinet is used, a reinforcing member needs to be provided inside the cabinet to prevent box resonance and increase rigidity. However, in the speaker system according to Embodiment 1, the structure of the acoustic tube 10 (especially, the structure in which the partition plate 11 is disposed in a spiral shape and connected to the front face plate 2 and the rear face plate 7) can also have an effect as a reinforcing member. It is thus unnecessary to provide a reinforcing member, especially for reinforcing the speaker cabinet 1.

Furthermore, the resonance of the acoustic tube 10 is generated at a frequency at which the length of the acoustic tube 10 is a half wavelength. As a result, the amplitude is suppressed, and the sound pressure level is also decreased, at the frequency.

For example, when the length of the acoustic tube 10 is 2 m as in Embodiment 1, the resonance of the acoustic tube 10 is generated at 85 Hz. When the characteristics at 85 Hz are checked in FIGS. 2 and 3, each of the sound pressures and the amplitudes is decreased.

For example, when the characteristics of the speaker unit 8 include a peak, the peak is reduced by matching the peak frequency with the resonance frequency of the acoustic tube 10, whereby the flatness of the sound pressure frequency characteristic can be improved although this is not used in Embodiment 1. This is also effective to the peak characteristic generated when the speaker unit 8 is attached to the cabinet.

Furthermore, to set each of the resonance frequency determined by the acoustic compliance determined by the back volume of the speaker unit 8 and the acoustic mass of the acoustic tube 10 (the first resonance frequency) and the resonance frequency determined by the length of the acoustic tube 10 (the second resonance frequency) to a target frequency, the cross section area of the acoustic tube 10 may be changed in part.

As a result, the second resonance frequency can be changed without changing the acoustic compliance determined by the back volume of the speaker unit 8 and the first resonance frequency.

Furthermore, in the acoustic tube 10 according to the present embodiment which has been exemplified in the description above, the cross section area perpendicular to the length direction of the acoustic tube is not small in part, that is, the cross section area perpendicular to the length direction of the acoustic tube 10 is the same in every part. An acoustic tube with this structure is referred to as a first acoustic tube.

However, the embodiment is not limited thereto. For example, one in which the cross section area perpendicular to the length direction of the acoustic tube 10 is small in part may be used as an acoustic tube. An acoustic tube with this structure is referred to as a second acoustic tube.

When the first acoustic tube and the second acoustic tube are compared, if the lengths thereof are the same, the acoustic mass of the second acoustic tube is larger than that of the first acoustic tube.

As described above, in the speaker system according to the present embodiment, resonance is generated at the resonance frequency determined by the acoustic mass of the acoustic tube 10 and the acoustic compliance determined by the back volume of the speaker unit 8 (the first resonance frequency).

When the length of the acoustic tube 10 attached inside the speaker cabinet 1 is limited, if the first acoustic tube is used as the acoustic tube 10, a resonance frequency lower than the resonance frequency corresponding to the length limit value may not be set as the first resonance frequency in some cases.

If the length of the first acoustic tube and that of the second acoustic tube are the same, as the acoustic tube 10 to be attached to the speaker cabinet 1, the second acoustic tube can be attached to obtain a larger acoustic mass compared with the first acoustic tube, whereby the value of the first resonance frequency can be set to a lower value than when the first acoustic tube is attached.

Furthermore, when the resonance frequency set when the first acoustic tube is used as the acoustic tube 10 to be attached to the speaker cabinet 1 is the same as the resonance frequency set when the second acoustic tube is used as the acoustic tube 10 to be attached to the speaker cabinet 1, the length of the second acoustic tube is shorter than that of the first acoustic tube. Thus, the second acoustic tube, of which the length is shorter than that of the first acoustic tube, can be used to obtain the resonance frequency when the first acoustic tube is used.

It should be noted that when the first acoustic tube as described above is used as the acoustic tube 10, the shorter the length thereof, the higher the resonance frequency determined by the length of the acoustic tube 10. It is thus desirable to set the length of the acoustic tube 10 short and thereby set the second resonance frequency (the resonance frequency determined by the length of the acoustic tube 10) to the outside of the reproduction band of the speaker system when a peak is not included in the sound pressure frequency characteristics and does not need to be suppressed.

In Embodiment 1, an electrodynamic type unit is used as the speaker unit 8. However, some other type of unit such as a piezoelectric unit may be used.

Furthermore, although the acoustic tube 10 is formed of one acoustic tube in the description above, the acoustic tube 10 may be formed of a plurality of acoustic tubes. For example, if two acoustic tubes, of which the cross section areas are half that of the acoustic tube 10 according to Embodiment 1 and the lengths are the same as that of the acoustic tube 10 according to Embodiment 1, are used to form a speaker system, the same effect as in the speaker system according to Embodiment 1 can be achieved.

(Embodiment 2)

Figure 5A:
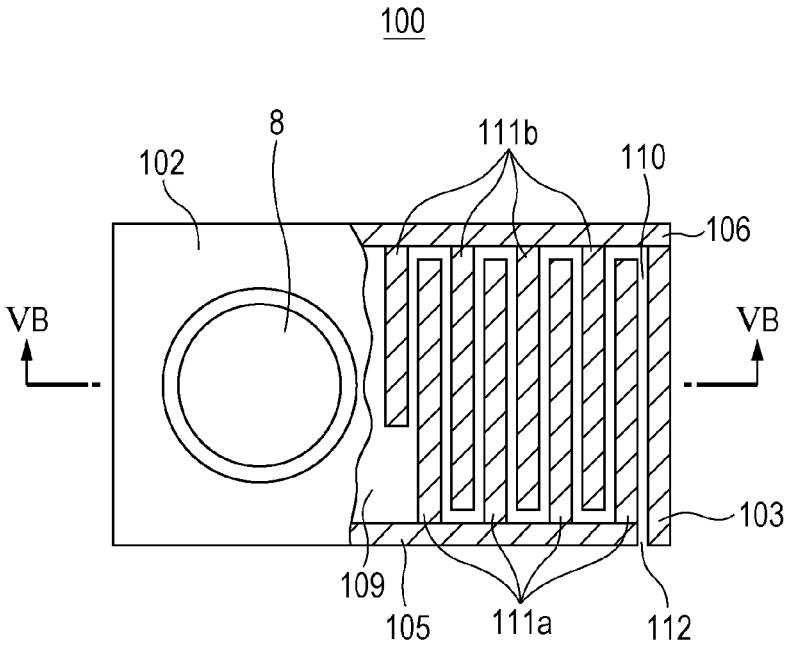
FIG. 5A is a plan view of a speaker system according to Embodiment 2 of the present disclosure.
Figure 5B:
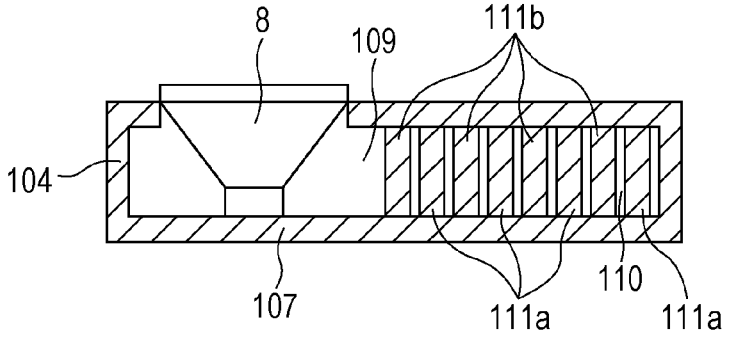
FIG. 5B is a cross-section view of the speaker system according to Embodiment 2 of the present disclosure.

FIG. 5A is a plan view of a speaker system part of which is cut off according to Embodiment 2 of the present disclosure. FIG. 5B is a cross-section view taken along line VB-VB in FIG. 5A.

The speaker system includes a speaker cabinet 100, a speaker unit 8 attached to a front face plate 102 of the speaker cabinet 100, partition plates 111*a* and 111*b* provided inside the speaker cabinet 100, and an opening 112 provided on a side face plate 105 of the speaker cabinet 100.

The speaker cabinet 100 includes the front face plate 102 to which the speaker unit 8 is attached, the side face plate 105 on which the opening 112 is provided, a side face plate 103, a side face plate 104, and a side face plate 106, which are for three faces other than the side face plate 105, a rear face plate 107, and the partition plate 111*a* (a first plate member) and the partition plate 111*b* (a second plate member), which are provided inside the speaker cabinet 100.

Furthermore, one end face of the partition plate 111*a* is connected to the side face plate 105 at the inner side of the speaker cabinet 100 (a first inner wall face of the speaker cabinet 100).

Furthermore, one end face of the partition plate 111*b* is connected to the side face plate 106 at the inner side of the speaker cabinet 100 (a second inner wall face of the speaker cabinet 100).

Furthermore, each of the partition plate 111*a* and the partition plate 111*b* is connected to the front face plate 102 at the inner side of the speaker cabinet 100 (a third inner wall face of the speaker cabinet 100).

Furthermore, each of the partition plate 111*a* and the partition plate 111*b* is connected to the rear face plate 107 at the inner side of the speaker cabinet 100 (a fourth inner wall face of the speaker cabinet 100). With this structure, the partition plate 111*a* and the partition plate 111*b* also have an effect as reinforcing members of the speaker cabinet 100.

The speaker system illustrated in FIGS. 5A and 5B has a plurality of the partition plate 111*a*.

The speaker system illustrated in FIGS. 5A and 5B has a plurality of the partition plate 111*b*.

The space between the partition plates 111*a* adjacent to each other and the space between the partition plates 111*b* adjacent to each other are the same, for example. Furthermore, the thicknesses of the partition plates 111*a* and the thicknesses of the partition plates 111*b* are the same, for example. And each space between the partition plate 111*a* and the partition plate 111*b* adjacent to each other is the same.

The space between the partition plates 111*a* adjacent to each other is larger than the thickness of the partition plate 111*b*.

Furthermore, the space between the partition plates 111*b* adjacent to each other and the space between the side face plate 103 and the partition plate 111*b* nearest to the side face plate 103 is larger than the thickness of the partition plate 111*a*.

Furthermore, the partition plate 111*a* is positioned between the partition plates 111*b* adjacent to each other and between the side face plate 103 and the partition plate 111*b* nearest to the side face plate 103.

At this time, at an end face (one end face) of the partition plate 111*a*, the partition plate 111*a* is connected to the side face plate 105 in the inner side of the speaker cabinet 100, and the end face opposite thereto (the other end face) is positioned away from the side face plate 106 in the inner side of the speaker cabinet 100.

Furthermore, at an end face (one end face) of the partition plate 111*b*, the partition plate 111*b* is connected to the side face plate 106 in the inner side of the speaker cabinet 100, and the end face opposite thereto (the other end face) is positioned away from the side face plate 105 in the inner side of the speaker cabinet 100.

With this structure, the partition plate 111*a*, the partition plate 111*b*, the front face plate 102, the rear face plate 107, the side face plate 103, the side face plate 105, and the side face plate 106 form the acoustic tube 110 having a shape meandering inside the speaker cabinet 100. One opening of the acoustic tube 110 is positioned in a back volume part 109 of the speaker unit 8, and the other opening is connected to an opening 112 provided between an end of the side face plate 105 and the side face plate 103.

With respect to the speaker system having the structure described above, the operation thereof is substantially the same as in Embodiment 1. A different point is the position where the acoustic tube 110 is formed.

In the speaker cabinet 1 according to Embodiment 1, the spiral-shaped acoustic tube 10 is formed by providing the spiral-shaped partition plate 11 formed along the four faces of the side face plate 3, the side face plate 4, the side face plate 5, and the side face plate 6.

By contrast, in Embodiment 2, one end of the partition plate 111*a* is connected to the side face plate 105 and one end of the partition plate 111*b* is connected to the side face plate 106, as illustrated in FIG. 5A.

With this structure, the rigidity of the speaker cabinet 100 is more improved and unnecessary sounds from the speaker cabinet 100 caused by vibrations of the speaker unit 8 are suppressed, compared with in Embodiment 1.

In Embodiment 2, the total internal volume obtained by adding the volume of the back volume part 109 to the internal volume of the acoustic tube 110 is 5 L, as in Embodiment 1. The speaker unit 8 is an electrodynamic type speaker having a diameter of 16 cm. The cross section of the acoustic tube 110 has an area of 65 mm length×11 mm width and has a length of 2 m. The percentage of the internal volume of the acoustic tube 110 is 28% to the total internal volume.

With the structure described above, the resonance frequency determined by the acoustic mass of the acoustic tube 110 and the acoustic compliance component of the back volume part 109 of the speaker unit 8 is set to 16 Hz.

The sound pressure characteristic and the amplitude characteristic with respect to the frequency in the speaker system according to Embodiment 2 are similar to those in FIGS. 2 and 3 and thus omitted here.

The structure, in which the speaker unit 8 is used and the resonance frequency is set to 16 Hz under the condition that the total cabinet volume is 5 L, is possible not only in the above-described acoustic tube 110 of 2 m. For example, in a case where the cross section area of the acoustic tube 110 is around ϕ9.5 mm, the length of the acoustic tube 110 can be 16 cm. In this case, the percentage of the internal volume of the acoustic tube 110 to the total internal volume of the speaker cabinet 100 is 0.3%.

In a low range at 100 Hz or lower, the sound pressure frequency characteristic excluding the characteristic at 85 Hz, which is the resonance frequency of the acoustic tube 110, is substantially the same.

Figure 6:
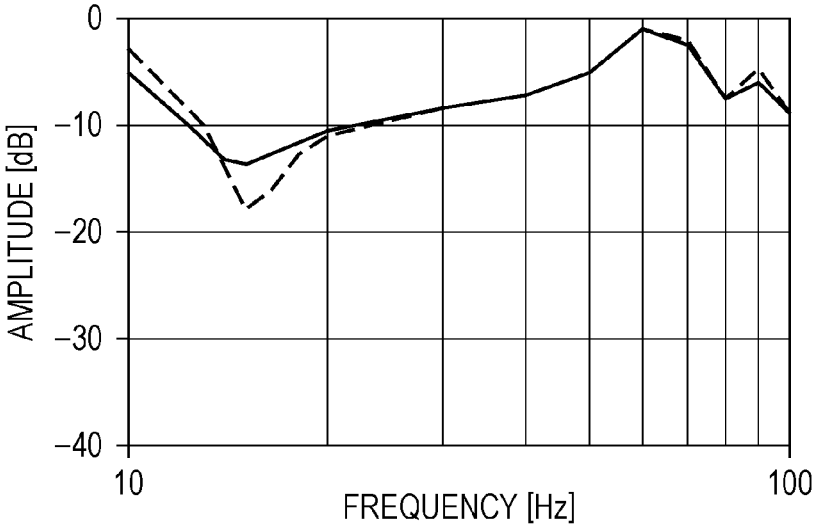
FIG. 6 is a diagram illustrating an amplitude frequency characteristic according to Embodiment 2 of the present disclosure.

FIG. 6 illustrates the amplitudes of the speaker unit 8 in the speaker system in a case where the length of the acoustic tube is 2 m and a case where that is 16 cm. In FIG. 6, the solid line represents the amplitude frequency characteristic in the case where the length of the acoustic tube used is 0.16 m in the speaker system according to the present embodiment. The dotted line represents the amplitude frequency characteristic in the case where the length of the acoustic tube used is 2 m in the speaker system according to the present embodiment.

Even when the acoustic tubes 110 are structured such that the resonance frequency is set to 16 Hz similarly, the amplitude of that of the acoustic tube having the length of 2 m is smaller at the resonance frequency of 16 Hz. This seems to be because the decreased cross section area of the acoustic tube 110 increases the viscosity of the air.

As a result, when the sound pressure levels are compared as the reproduction sound pressure levels in a case where the amplitudes are the same, the sound pressure level of the speaker system according to Embodiment 2, in which the length of the acoustic tube 110 is 2 m, is higher.

Figure 7:
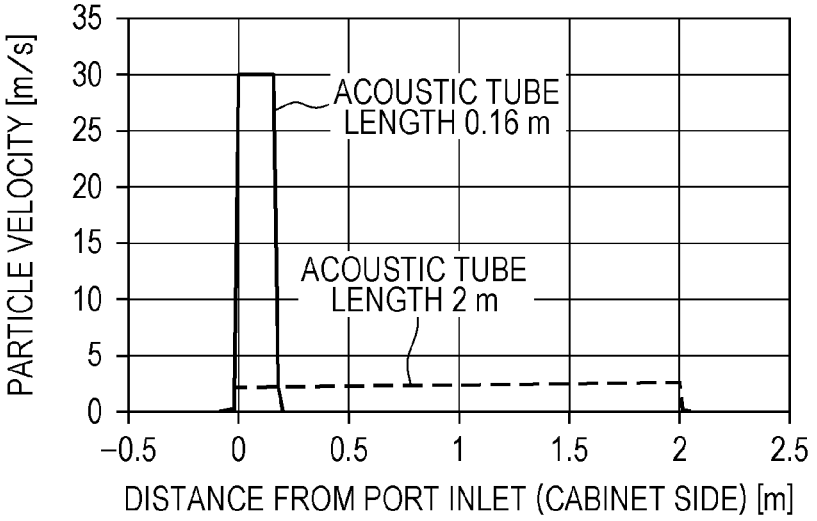
FIG. 7 is a diagram illustrating a particle velocity characteristic according to Embodiment 2 of the present disclosure.

Furthermore, the particle velocities generated in the acoustic tube 110 are compared between the acoustic tube lengths of 2 m and 16 cm. FIG. 7 illustrates the particle velocity characteristics inside the acoustic tube 110 at 16 Hz.

The particle velocity with the acoustic tube length of 16 cm is about ten times higher than that of the acoustic tube 110 according to Embodiment 2. As a result, wind noises are generated in the speaker system with the acoustic tube length of 16 cm. In other words, with the acoustic tube length of 16 cm, even if the resonance frequency can be set to 16 Hz, that system does not hold good characteristic as a speaker system.

Accordingly, for the system to be used as a speaker system in view of conditions related to the particle velocities inside the acoustic tube 110 and prevention of wind noises, the percentage of the internal volume of the acoustic tube 110 to the total internal volume of the speaker cabinet 100 needs to be 5% or higher.

Figure 8:
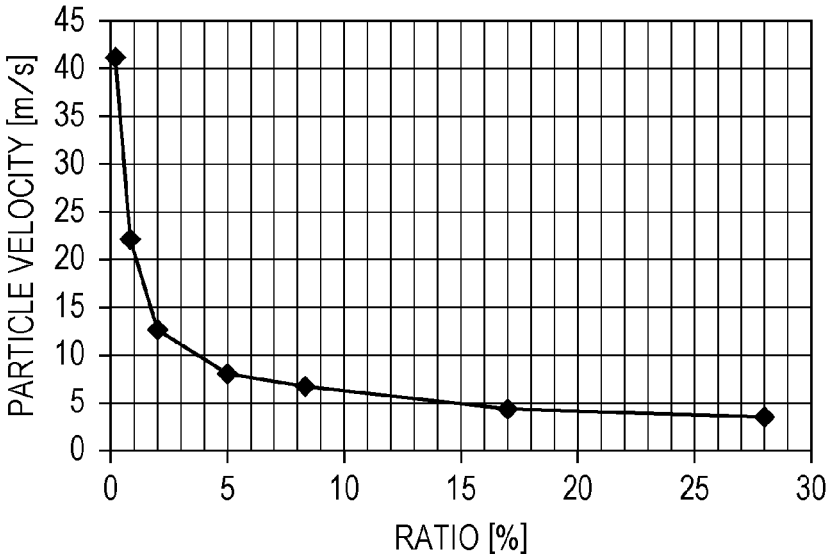
FIG. 8 is a diagram illustrating the relation between a ratio of the volume of an acoustic tube to the total internal volume and a particle velocity inside the acoustic tube according to Embodiment 2 of the present disclosure.

Furthermore, FIG. 8 illustrates the relation between the ratio of the volume of the acoustic tube to the total internal volume and the particle velocity inside the acoustic tube. As can be seen from this result, as the percentage of the internal volume of the acoustic tube becomes lower than 5%, the value of the particle velocity inside the acoustic tube is rapidly increased. This indicates that the percentage of the internal volume of the acoustic tube to the total internal volume of the speaker cabinet needs to be 5% or more.

It should be noted that the thickness values of the partition plates in Embodiments 1 and 2 are not limited as long as the rigidity of the speaker cabinet can be secured by using that partition plate.

Furthermore, the acoustic tube 110 connects the partition plate 111*a*, the partition plate 111*b*, and the front face plate 102 and the rear face plate 107 to which the speaker unit 8 is attached. However, the embodiments are not limited thereto. For example, a plurality of partition plates may be connected in a tube shape so as to form an acoustic tube in a meandering shape. In this case, it is desirable that the aspect ratio of the cross section of the acoustic tube be prioritized.

For example, when an acoustic tube formed in a meandering shape by a plurality of partition plates connected in a tube shape is used, this acoustic tube may be disposed along the inner wall faces of the side face plate 103, the side face plate 104, the side face plate 105, and the side face plate 106.

In the acoustic tube in a meandering shape, when the shape of the inner walls on which the bending parts in the meandering are present is a curved surface shape (R-shape), the continuity of the particle velocity inside the acoustic tube is improved.

Furthermore, as in Embodiment 1, when the characteristics of the speaker unit include a peak, the peak can be reduced by matching the peak frequency with the resonance frequency of the acoustic tube.

Furthermore, disposing a sound absorption material inside the acoustic tube (for example, at the inlet part on the cabinet side) can reduce rapid changes (dips) of the amplitude characteristic in the vicinity of the second resonance frequency determined by the length of the acoustic tube.

In Embodiment 2, the cross section area of the acoustic tube 110 is constant. However, the shape of the opening thereof may be R-shaped. This leads to reduction of wind noises.

Although the speaker systems according to the embodiments have been described with reference to the drawings, the present disclosure is not limited to those in the illustrated embodiments. In the illustrated embodiments, various modifications and variations may be made within the scope the same as or equivalent to the present disclosure.

The present disclosure can be applied to a speaker system characterized by low-frequency range reproduction such as one for a vehicle or a TV.

What is claimed is:

1. A speaker system, comprising:

a speaker cabinet that has an opening;

a first speaker, including a first diaphragm, attached to the speaker cabinet; and at least one acoustic tube opened at both ends thereof, wherein one end of the acoustic tube is positioned inside the speaker cabinet, wherein the other end of the acoustic tube is connected to the opening, wherein an amplitude of vibration of the first diaphragm of the first speaker vibrated by applying a first AC signal, having a frequency included in a first frequency band, to the first speaker is lower than an amplitude of vibration of a second diaphragm of a second speaker vibrated by applying a second AC signal being the same as the first AC signal to the second speaker in a manner that the second speaker, being the same as the first speaker, is attached to a closed type cabinet having the same internal volume as the speaker cabinet, wherein when an amplitude of vibration of the first diaphragm vibrated by applying a correction AC signal together with the first AC signal to the first speaker is equalized to the amplitude of vibration of the second diaphragm, a sound pressure reproduced by vibration of the first diaphragm is equal to or lower than a sound pressure reproduced by vibration of the second diaphragm by applying a third AC signal having a frequency equal to or higher than a minimum resonance frequency of the closed type cabinet determined by the internal volume of the closed type cabinet and the caliber of the second speaker is applied to the second speaker, wherein the correction AC signal has the same frequency as the first AC signal, wherein an amplitude of the third AC signal is the same as an amplitude of the first AC signal, wherein the first frequency band includes a first resonance frequency determined by an acoustic mass of the acoustic tube and an acoustic compliance component which is determined by an internal volume of the speaker cabinet excluding a volume of the acoustic tube, and wherein the first resonance frequency is lower than the minimum resonance frequency of the closed type cabinet.

2. The speaker system according to claim 1, wherein the acoustic tube is spiral-shaped.

3. The speaker system according to claim 2, wherein the acoustic tube is structured by connecting a spiral-shaped plate member disposed inside the speaker cabinet and two inner wall faces facing each other out of the inner wall faces of the speaker cabinet.

4. The speaker system according to claim 2, wherein the spiral-shaped plate member also serves as a reinforcing member of the speaker cabinet.

5. The speaker system according to claim 1, wherein the shape of the acoustic tube is a meandering shape inside the speaker cabinet.

6. The speaker system according to Claim further comprising:

a plurality of first plate members each having one end face connected to a first inner wall face of the speaker cabinet; and a second plate member with one end face connected to a second inner wall face of the speaker cabinet, the second inner wall face facing the first inner wall face, wherein the plurality of first plate members are disposed spatially apart from each other and the other end face of each of the plurality of first plate members opposite the one end face of each of the plurality of first plate members are positioned away from a second inner wall face, wherein the second plate member is disposed in a position between the first plate members adjacent to each other and away from each of the first plate members adjacent to each other, wherein the other end face of the second plate member opposite the one end face of the second plate member is positioned away from the first inner wall face, and wherein the acoustic tube is formed of the plurality of first plate members and the second plate member respectively connected to a third inner wall face and a fourth inner wall face that are two inner wall faces facing each other out of the inner wall faces of the speaker cabinet and respectively different from the first inner wall face and the second inner wall face.

7. The speaker system according to claim 6, wherein the first plate member and the second plate member also serve as reinforcing members of the speaker cabinet.

8. The speaker system according to claim 1, wherein the cross section area perpendicular to the length direction of the acoustic tube is made smaller in part.

9. The speaker system according to claim 1, wherein the first frequency band is a frequency band of 16 Hz to 45 Hz, and wherein a sound pressure reproduced by vibration of the first diaphragm when a first AC signal having a frequency in the vicinity of the first resonance frequency is applied to the first speaker is substantially the same as a sound pressure reproduced by vibration of the second diaphragm when a second AC signal being the same as the first AC signal is applied to the second speaker.

10. The speaker system according to claim 9, wherein being substantially the same indicates that the absolute value of the difference between the sound pressure reproduced by vibration of the first diaphragm and the sound pressure reproduced by vibration of the second diaphragm is within 1 dB.

11. The speaker system according to claim 1, wherein the percentage of the internal volume of the acoustic tube to that of the speaker cabinet is equal to or higher than 5%.

12. The speaker system according to claim 1, wherein a second resonance frequency determined by a length of the acoustic tube substantially coincides with the peak frequency of the sound pressure of the first speaker attached to the speaker cabinet.

13. The speaker system according to claim 1, wherein a sound absorption material is disposed as part of the acoustic tube.

14. The speaker system according to claim 1, wherein the acoustic tube forms surrounding walls of the speaker cabinet.

15. The speaker system according to claim 1, wherein, when the same AC signal having a frequency of a second frequency that is lower than the minimum resonance frequency and different from the first frequency band is applied to each of the first speaker and the second speaker, the sound pressure reproduced by vibration of the first diaphragm is substantially the same as the sound pressure reproduced by vibration of the second diaphragm.

16. The speaker system according to claim 15, wherein being substantially the same indicates that the absolute value of the difference between the sound pressure reproduced by vibration of the first diaphragm and the sound pressure reproduced by vibration of the second diaphragm is within 1 dB.

* * * * *